United States Patent [19]

Tong

[11] 4,081,133

[45] Mar. 28, 1978

[54] TOY TRACK SECTION WITH ELECTRICAL CONNECTOR SAFETY MEANS

[75] Inventor: Duncan Tong, Hong Kong, Hong Kong

[73] Assignee: Playart Limited, Hong Kong

[21] Appl. No.: 705,094

[22] Filed: Jul. 14, 1976

[30] Foreign Application Priority Data

Jul. 16, 1975 United Kingdom ..... 29944/75

[51] Int. Cl.[2] ..... A63H 19/30

[52] U.S. Cl. ..... 238/10 F; 46/1 K; 104/DIG. 1

[58] Field of Search ..... 46/1 K, 216; 104/53, 104/60, 147 A, DIG. 1; 29/453; 238/10 R, 10 A, 10 F; 339/20, 21, 22 R, 66 R, 66 M, 75 M, 75 MP, 91 R, 61 R, 61 C, 61 LM, 252 R

[56] References Cited

U.S. PATENT DOCUMENTS

| | | | |
|---|---|---|---|
| 2,232,511 | 2/1941 | Caruso | 238/10 C |
| 3,313,242 | 4/1967 | Voce | 104/60 |
| 3,520,475 | 7/1970 | Ernst | 238/10 F |
| 3,916,103 | 10/1975 | Morrell et al. | 339/75 M |

FOREIGN PATENT DOCUMENTS

| | | | |
|---|---|---|---|
| 1,152,035 | 2/1958 | France | 238/10 E |
| 702,479 | 1/1954 | United Kingdom | 238/10 C |

*Primary Examiner*—Drayton E. Hoffman
*Assistant Examiner*—Carl Rowold
*Attorney, Agent, or Firm*—Wood, Herron & Evans

[57] ABSTRACT

A toy track for use with electrically operated self-propelled toys such as vehicles or railway trains comprising a plurality of track section, each track section including at least one pair of electrically conductive rails extending substantially the length of the section and provided at least at one end with an electrical junction means adapted to be joined with a corresponding electrical junction means on the adjacent section, said junction means comprising on the one section an insulating member which protrudes from the end of the track section in overlapping relationship with the adjacent track section and on the adjacent track section a recess adapted to receive said projecting portion, said projecting portion mounting and projecting beyond at least one electrically conductive member for coupling a conductive rail of the respective track section with the conductive rail of the adjacent track section.

9 Claims, 4 Drawing Figures

TOY TRACK SECTION WITH ELECTRICAL CONNECTOR SAFETY MEANS

The present invention relates to toy tracks for use with electrically operated self-propelled toys such as vehicles or railway trains.

Such tracks must necessarily include conductive rails to supply electrical power to the vehicles or trains and junctions for the rails between adjacent sections of the track. In the prior art these junctions usually comprise metal pieces which project from the ends of the track sections and which enter into specially provided sockets in the adjacent track sections. Such protruding members, beig metal, are inclined to be somewhat sharp and have the disadvantage that they may be dangerous for children.

It is an object of the invention to overcome this disadvantage and also to provide easily connectible track sections. Thus, in accordance with the invention, there is provided a toy track for use with electrically operated self-propelled toys such as vehicles or railway trains comprising a plurality of track sections, each track section including at least one pair of electrically conductive rails extending substantially the length of the section and provided at least at one end with an electrical junction means adapted to be joined with a corresponding electrical junction means on the adjacent section, said junction means comprising on the one section an insulating member which protrudes from the end of the track section in overlapping relationship with the adjacent track section and on the adjacent track section a recess adapted to receive said projecting portion, said projecting portion mounting and projecting beyond at least one electrically conductive member for coupling a rail of the respective track section with the rail of the adjacent track section.

In one embodiment, described herein, the projection portion of the track section is adapted to be joined with a corresponding recess in the adjacent track section in a direction parallel to the plane of the track.

The invention will now be described by way of example with reference to the accompanying drawings, in which.

Figure 1:
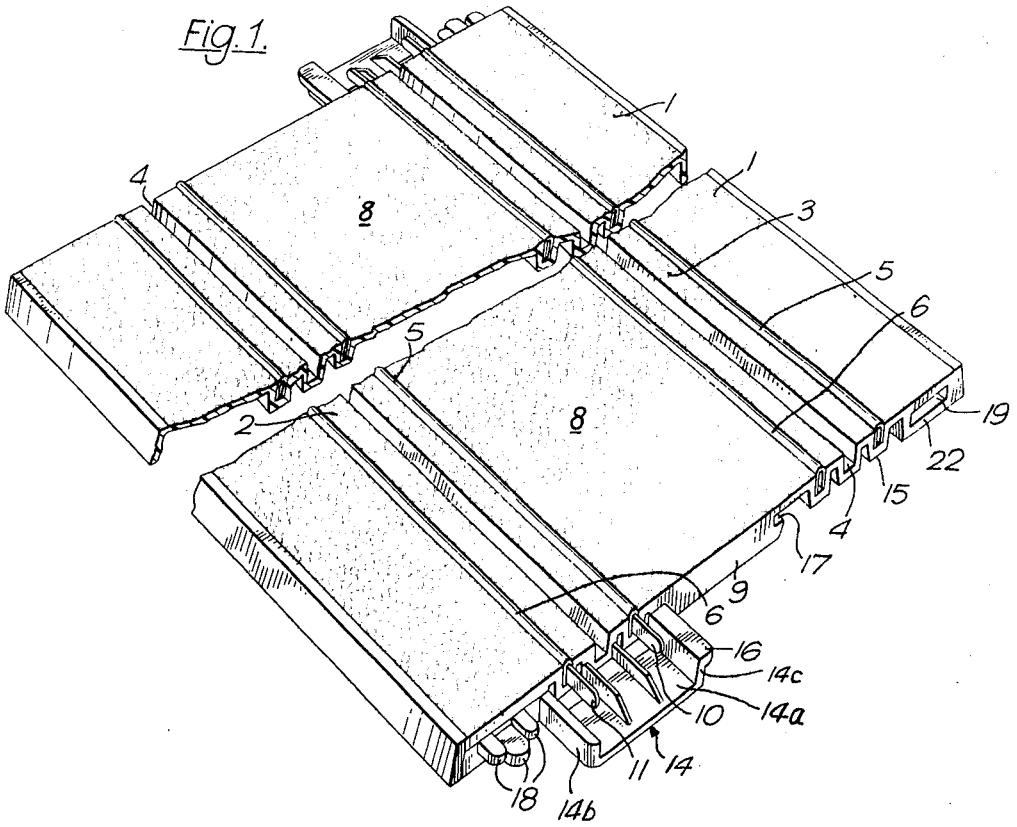
FIG. 1 is a top perspective view of part of a track section according to the invention.
Figure 2:
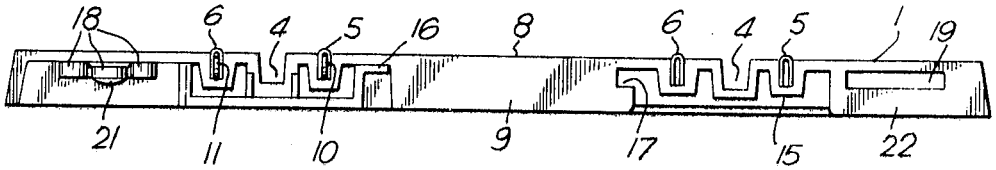
FIG. 2 is an enlarged end view of the part of the track section shown in FIG. 1.
Figure 3:
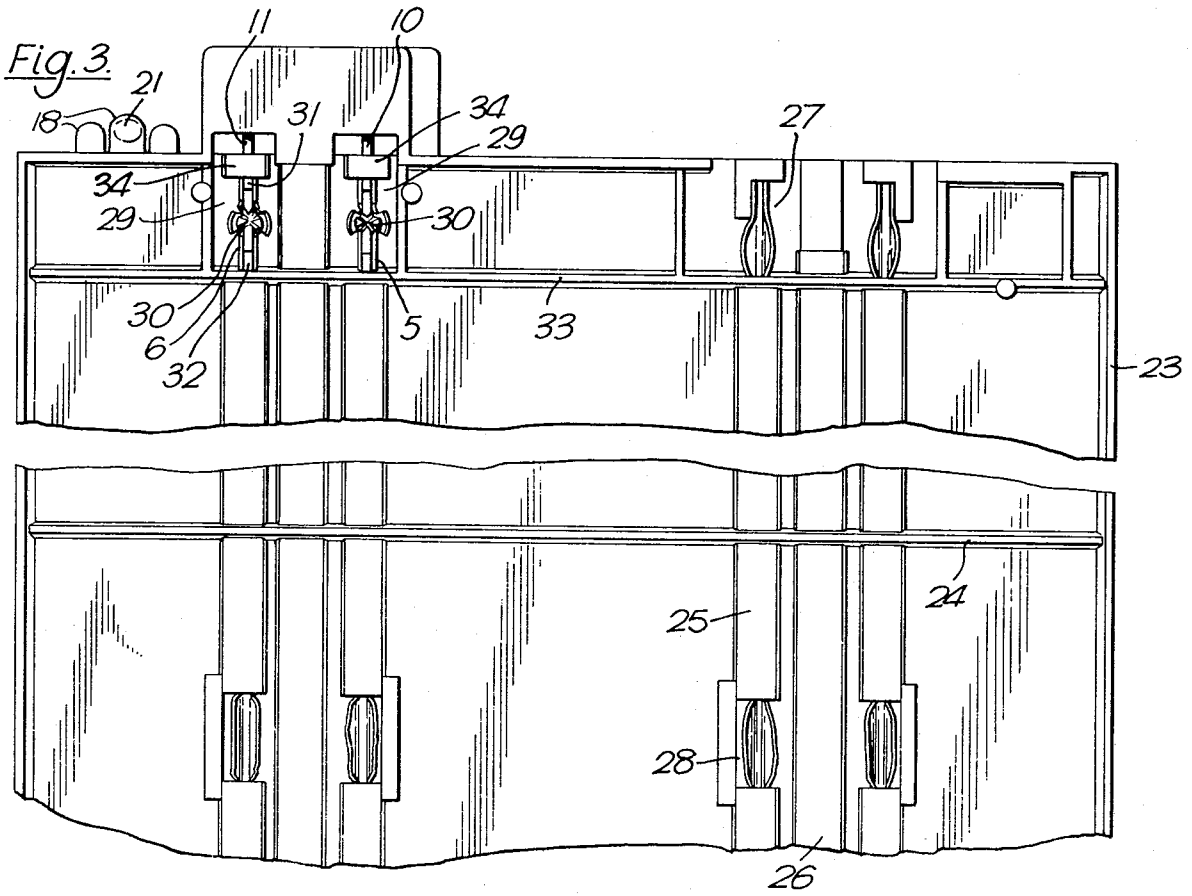
FIG. 3 shows an underplan view of the end and part of the middle of the track section shown in FIG. 1.

Referring now to FIGS. 1 to 3 part of the track section is shown generally at 1. Dual tracks used specifically for toy racing cars are provided at 2 and 3. Each track consists of a guide groove 4 in which a lug extending downwardly from the car, and two conductor rails 5 and 6, which extend from one end of the track section 1 to the other.

The conductor rails 5 and 6 are made from 'U' shaped metal strips and are buried in the plastic base 8 of the track section so tha only the upper surface being the base of the 'U', project slightly above the base. At the ends of the section the conductor rails 5 and 6 terminate flush with the surface 9 of the base 8. In track 2 at one end of the track section the conductor rails are connected to connection members 10 and 11 which as may be seen in FIG. 3 are riveted to the conductor rails 5 and 6 respectively on the under side of the base 8. In order to protect the users of the tracks from hurting themselves on the projecting connection members 10 and 11, there is provided a safety projection 14 of the base 8. The projection 14 projects outwardly from the end surface 9 in the direction of the rails 5 and 6. The projection 14 includes base wall 14*a* and side walls 14*b*, 14*c* that extend upwardly from the base wall; note particularly that the projection 14 is, therefore, open at the top, i.e., includes no roof wall, thereby exposing connection members 10 and 11 to view for facilitating assembly of adjacent track sections, all as shown in FIG. 1. Thus, the connection members 10, 11 are exposed to view only when the track section is viewed from a line of sight that permits viewing of, and is perpendicular to, the track surface over which the toy cars are adapted to move as shown in FIG. 1.

The projection 14 is constructed so that no metal parts of rails or connection members project beyond the confines of the projection and it thus provides a guard against children cutting themselves. The projection 14 has a wing 16 parallel to the plane of the track. This wing enters a corresponding extension 17 of the recess 15. The said wing 16 and extension 17 form one part of a retaining means to hold one track section on to and alignment with an adjacent track section. A further set of projections 18 are provided along side the projection 14 and a corresponding recess 19 is provided in the base 8 in the end face 9 of the section. The centre one of the further set of projections 18 has a downwardly projecting boss 21 which engages a thin section wall 22 bounding the corresponding recess 19.

When engaging two track sections the end walls of the sections are offered to each other so that the tracks are in the same plane and so that the projections enter the corresponding recess. This brings the connection members 10 and 11 into engagement with the 'U' shaped inner surface of the conductor rails 5 and 6. When the projections have fully entered their corresponding recesses the track sections are then in full engagement and aligned with each other. The base 8 of the section is a this walled plastic moulding strengthened underneath by side walls 23 and webs 24. Additional ribs 25 and 26 are moulded on the underside to provide a material which defines the respective rail and guide grooves. The rail grooves are interupted at intervals 27 and 28 for example at the ends of the track sections and intermediate of the ends of the track sections respectively, so as to expose the under side of the rails 5 and 6. Mechanical attachments of the rails 5 and 6 to the base 8 and mechanical and electrical connection between rails and the electrical contacts and connection members is secured by staking or crimping an exposed underside of the rails 5 and 6. So that part of the rails overlap the underside of the base 8 and effectively rivet the rails to the base 8.

It will be seen in FIG. 3 that at interruptions 29 in the rail grooves at one end of the track section where the connection members 10 and 11 are riveted, (staked or crimped) to the conductor rails 5 and 6 at position 30, the connection members are retained in a riveting position by downwardly projecting portions 31 and 32 which locate against the sides of 33 and base end portions 34. It will be seen that the construction of the 'U' shaped rails with the joined connection members as designed to reduce the amount of metal used in the construction to a minimum. The design is advantageous in this respect.

Figure 4:
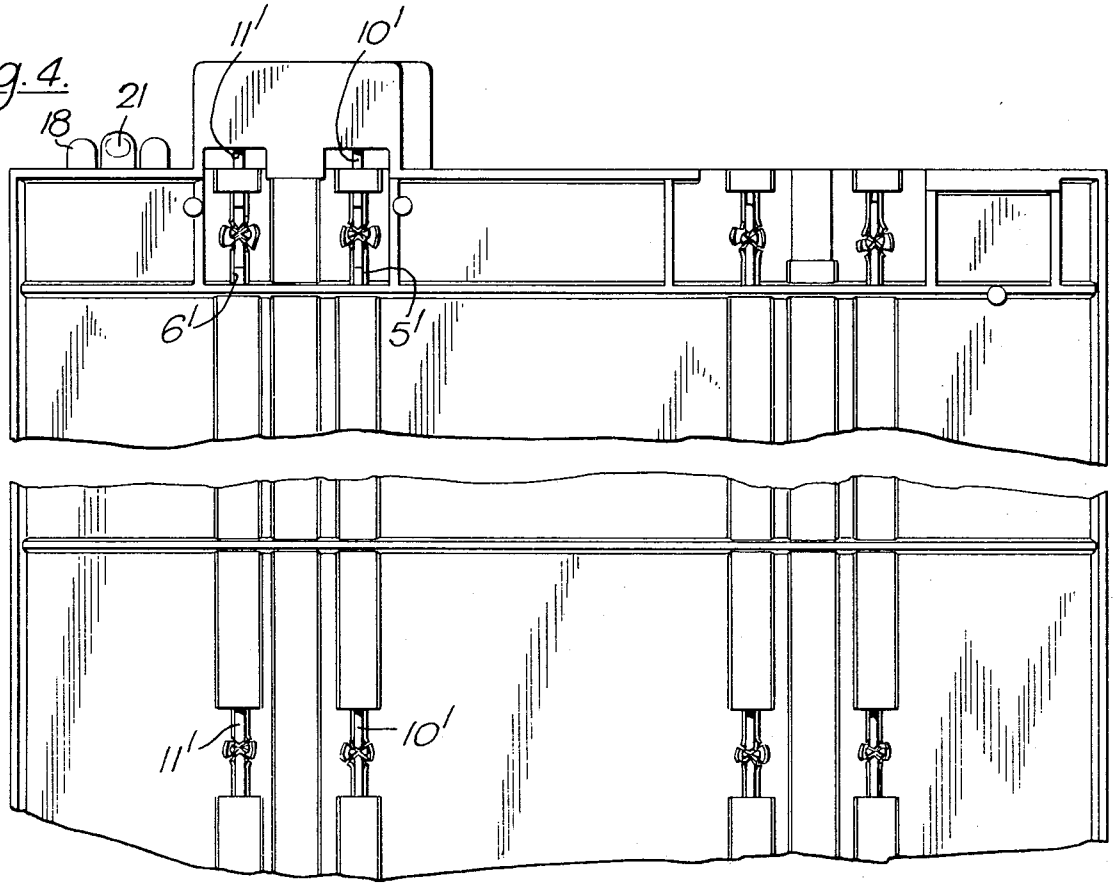
FIG. 4 shows an underplan view similar to that of FIG. 3 but with a different arrangement for securing the track rails to the base of the track.

In FIG. 4 a slightly different method of joining the connection members to the rails is provided whereby connection members 11' and 10' and in this respect they are simple to manufacture but of course use more metal.

On one or more track sections of a set of electrical connectors are provided on one side of the track these connectors are electrically connected to shoes by metal strips. The shoes are connected to the track at the intermediate intervals 28 by placing them over the downwardly extending parts of the rails 5 and 6 and by riveting the rails over the shoes in the same way. The shoes also serve to lock the rails to the track base. It should be understood that track segments are of several formations, for example the track may be straight, curved and can have cross-overs or points, the cross-overs can have the connector rails conducted on the upper surface. Furthermore all such sections may have electrical connectors provided.

In order to provide additional grip for the members 10 and 11 with the interior surface of 'U' shaped rails 5 and 6 of the adjoining track sections it is advantageous to provide a slight kink in the protruding portions of members 10 and 11. Further the member 10 and 11 may extend, within rails 5 and 6, from one end of each track section 1 to the other if desired.

What we claim is:

1. A toy track for use with electrically operated self-propelled toys such as vehicles or railway trains, said toy track including a plurality of track section, each track section comprising a pair of electrically conductive rails extending substantially the length of said track section, said rails being mounted on a base, electrical connection members connected to one end of said conductive rails, at least one of said electrical connection members extending beyond the end edge of said base, and said electrical connector members being adapted to join with a pair of electrically conductive rails on an adjacent track section, a safety projection member connected to said track section closely adjacent said electrical connector member, said safety projection member being comrised of a base wall and opposed side walls only with the electrical connector member positioned between the side walls, that structure of said projection member exposing said electrical connection members to view when said track section is unconnected to an adjacent track section and when said track section is viewed from a line of sight that permits viewing of and is perpendicular to the track surface over which said toys are adapted to move, and said base wall and side walls extending from the end edge of said base beyond the exposed end of said electrical connection member for preventing contact of that end of said electrical connection member with a user when said track section is unconnected to an adjacent track section, and retaining means formed integral with said safety projection member, said retaining means being adapted to cooperate with an adjacent track section for connecting together said track section and an adjacent track section in operative relation.

2. A toy track according to claim 1 wherein said projection member of said track section is adapted to be joined with a corresponding recess in an adjacent track section in a direction parallel to the plane of the track.

3. A toy track according to claim 2 further comprising detent means for resisting the separation of adjacent track sections, said detent means comprising a raised boss on a projection portion of said track section which projects in a plane parallel to the plane of said track section and a thin walled portion bounding a recess in the adjacent track section, said recess being arranged to slidingly receive said projection portion when the track sections are joined, said track sections being so designed as to allow resilient relative displacement of the thin walled portion.

4. A toy track according to claim 1 wherein said track section is provided with said safety projection member at one end and a recess at the other end, said recess being structured to receive the safety projection member and the electrical connection member of an adjacent track section when said track section is connected to said adjacent track section.

5. A toy track as claimed in claim 4 wherein the connection members at least partially extend the length of the conductive rail and are riveted, staked or crimped to a conductive rail.

6. A toy track as claimed in claim 1 wherein the connection members extend only a part of the length of the conductive rails and are riveted, staked or crimped to the conductive rails.

7. A toy track according to claim 1 wherein the conductive rails are contained in slots in a track base.

8. A toy track according to claim 7 wherein the conductive rails are secured to the track base through apertures in the base by riveting, crimping or staking the said rail on the underside of the track base.

9. A toy track according to claim 8 wherein the rails are also secured to the track base by means of metal shoes which are positioned in the said apertures and themselves have apertures through which riveting, crimping or staking of the rails is effected.

* * * * *